United States Patent [19]

Glaser

[11] Patent Number: 5,036,737

[45] Date of Patent: Aug. 6, 1991

[54] WEB CUTTING MACHINE, PARTICULARLY FOR SEVERING PRINTED PAPER WEBS RECEIVED FROM A PRINTING MACHINE

[75] Inventor: Bernd Glaser, Augsburg, Fed. Rep. of Germany

[73] Assignee: Man Roland Druckmaschinen AG, Offenbach am Main, Fed. Rep. of Germany

[21] Appl. No.: 528,587

[22] Filed: May 24, 1990

[30] Foreign Application Priority Data

Jun. 1, 1989 [DE] Fed. Rep. of Germany ..... 3917845

[51] Int. Cl.[5] ..... B65H 35/08

[52] U.S. Cl. ..... 83/100; 83/98; 83/402

[58] Field of Search ..... 83/22, 24, 98, 99, 100, 83/402, 346, 343

[56] References Cited

U.S. PATENT DOCUMENTS

| | | | |
|---|---|---|---|
| 1,643,120 | 9/1927 | Hoener | 83/98 |
| 3,143,016 | 8/1964 | Obenshain | 83/98 |
| 3,322,037 | 5/1967 | Cavagnero | 83/100 X |
| 3,405,855 | 10/1968 | Daly et al. . | |
| 3,405,884 | 10/1968 | Patterson, Jr. . | |
| 3,875,836 | 4/1975 | Hutchinson et al. | 83/18 |
| 3,976,237 | 8/1976 | Bossons | 83/402 X |
| 4,385,537 | 5/1983 | Wolf | 83/100 |
| 4,771,666 | 9/1988 | Ikeuchi et al. | 83/99 |

FOREIGN PATENT DOCUMENTS

| | | |
|---|---|---|
| 608707 | 1/1935 | Fed. Rep. of Germany . |
| 944919 | 6/1956 | Fed. Rep. of Germany . |
| 1278450 | 9/1968 | Fed. Rep. of Germany . |
| 6925525 | 6/1969 | Fed. Rep. of Germany . |
| 2142902 | 3/1973 | Fed. Rep. of Germany . |
| 816859 | 7/1959 | United Kingdom . |
| 2006292 | 5/1979 | United Kingdom . |

OTHER PUBLICATIONS

"Lithoman M", p. 6.

*Primary Examiner*—Douglas D. Watts
*Assistant Examiner*—Eugenia A. Jones
*Attorney, Agent, or Firm*—Frishauf, Holtz, Goodman & Woodward

[57] ABSTRACT

To direct the leading edge of a cut web element, cut by knives (3) on a cutter cylinder pair (1, 2), to an inlet region of transport belts (6, 7) running over deflection rollers (8, 9), air jet nozzles (10, 11) direct an air cushion or air pillow into the nip between the cylinders (1, 2). The cylinders are formed with a plurality of circumferential grooves (18, 19) or a spiral groove (21), so that the air can pass along the nip and continue to guide the cut leading edge of the web. Suction nozzles 22, 23 enhance the air cushion effect applied to both sides of the web. If the web is a multi-ply structure, the air cushion or air pillow additionally contributes to adhesion of the various plies against each other.

11 Claims, 2 Drawing Sheets

WEB CUTTING MACHINE, PARTICULARLY FOR SEVERING PRINTED PAPER WEBS RECEIVED FROM A PRINTING MACHINE

FIELD OF THE INVENTION

The present invention relates to a cutter arrangement for a web received from a printing machine, and more particularly to a cutter arrangement for combination with a folder system of a printing machine in which two cutter cylinders sever a vertically supplied printed web.

BACKGROUND

Folders which are supplied with paper webs from a printing machine are described in the prospectus "Lithoman M", page 6, published by the assignee of the present application. Typically, the paper web is supplied by guide rollers, vertically, to a pair of cutter cylinders. The cut web portions or cut sheets are then supplied to a belt system for further transport. The cut sheets, immediately after being cut and before they are gripped by the transport belts, are not guided. It is possible that the forward cut edges of the products have the tendency to remain for a short period of time on the teeth of the cutter knife of one of the cutting cylinders. The web is supplied to the cutting cylinders at high speed. If the forward or leading edge separates from the knives only with a slight delay, the direction in which the cut product is removed from the cutter cylinder changes from a desired vertical path, and the front edge may impinge against a deflection roller for the transport belts and, upon pull-in between the transport belts, may result in bent-over corners.

The forward edges of the cut sheets may also adhere to the cutter cylinders due to electrostatic charges. Such electrostatic charges can occur during operation of the cutter cylinders handling the sheets; in addition, however, frequently electrostatic charges are applied to the web when the web is a multi-ply composite structure, in which the respective plies of the web are charged to adhere them together and, later on, to provide for adherence of the individual plies, now individual cut sheets or portions, for further transport.

THE INVENTION

It is an object to provide a guide system for the cut products in the region between the cutting cylinders and the transport belts, so that precise entry of the leading edge of the web, to be cut into sheets or cut portions or elements between the transport belts of a belt system is ensured.

Briefly, a pair of cutter cylinders, having respectively at least one cutting blade and counter blade thereon, are positioned to receive a single or multi-ply web structure and, after cutting, transport the leading edge of the cut sheet between a group of belts, located downstream, with respect to web travel, of a nip between the cutter cylinders. In accordance with a feature of the invention, an air jet is positioned at either side of the web upstream of the nip; and the cutter cylinders are formed with at least one circumferential groove to permit the air emitted by the jets to pass along the web as it is traveling between the nip, and then downstream thereof.

This system, thus, provides an air cushion or air pillow which guides the web, and then the cut elements until it reaches and is gripped by the transport belts.

Preferably, suction nozzles are located at the inlet side to the transport belt system to suck off the air which is injected upstream of the nip between the cutter cylinders. This arrangement additionally enhances the formation of air pillows or air regions which guide the products, and reduces turbulence of the air behind the cutter cylinders.

In accordance with a feature of the invention, and in order to permit ready matching of the air guidance of the web and the cut sheet which have different thicknesses, or different numbers of layers or plies, the jets are located or arranged so that the direction of the air blasted out therefrom can be controlled. Likewise, it is desirable in accordance with a preferred form of the invention to provide for apparatus to control the volume of the air ejected by the air jets and/or the volume of air being sucked away by suction apparatus.

DRAWINGS

DETAILED DESCRIPTION

Figure 1:
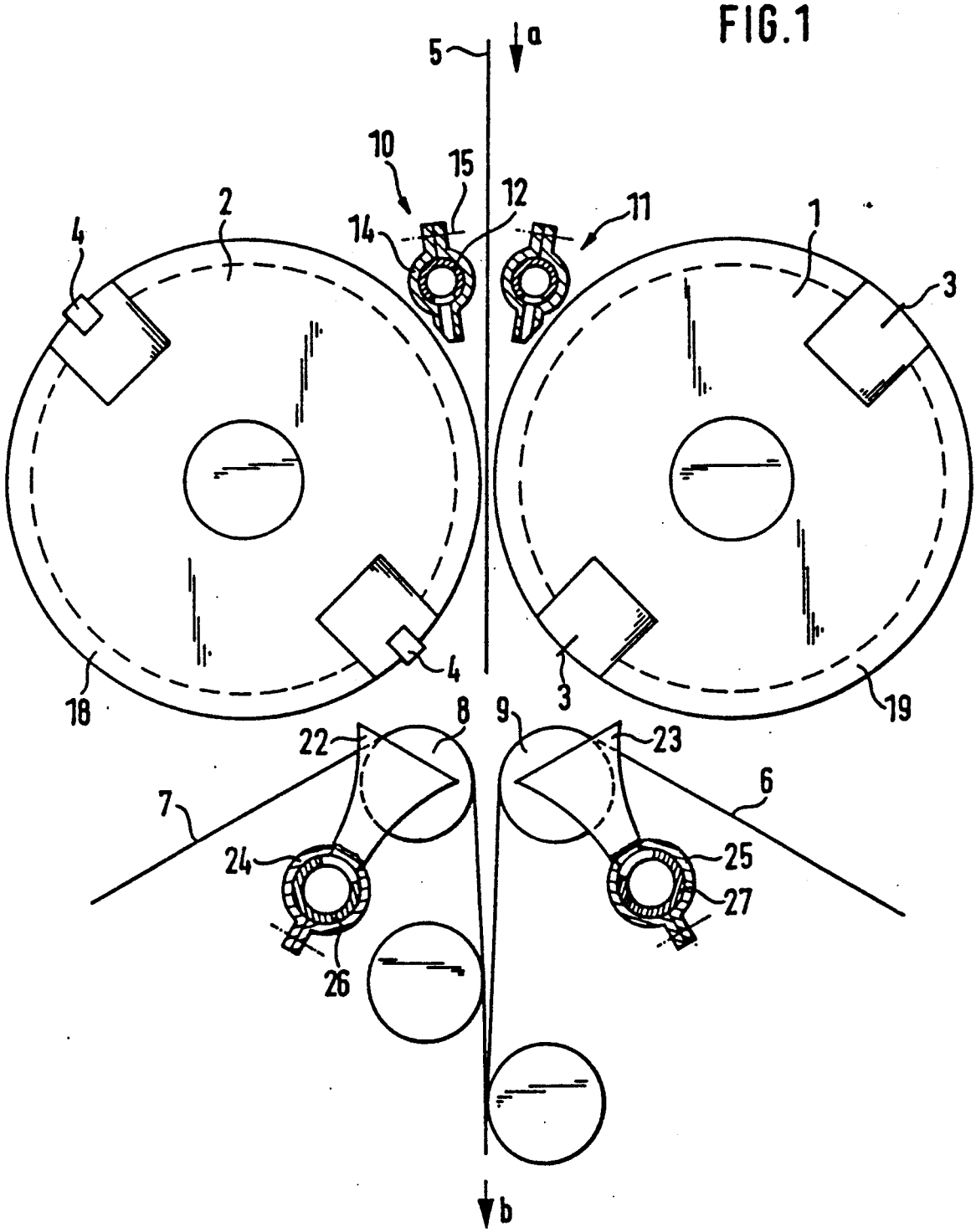
FIG. 1 is a schematic side view of a rotary cutter system, shown radially expanded for ease of illustration.

Two cutter cylinders (1, 2 (FIGS. 1, 2) are located with respect to each other to form a nip therebetween. One of the cutter cylinders, in the illustration cutter cylinder 1, carries two knife blades 3, the other cutter cylinder having counter elements 4 thereon. The knife blades may be serrated. A web 5, supplied for example by supply rollers, not shown, in the direction of the arrow a, is fed towards the nip between the cylinders 1, 2 to be cut therein. The then severed cut products are gripped between transport belts 6, 7, to be further transported in a direction of the arrow b. The transport belts 6, 7 are formed by a plurality of laterally spaced narrow belt or tape units, guided over deflection rollers 8, 9 and driven in any suitable and well known manner.

The web 5 may be a single-ply web, or may be formed of a plurality of web elements, located adjacent each other, to form a multi-ply web.

In accordance with a feature of the invention, air jet nozzles 10, 11 are located at both sides of the web 5. The nozzles are supplied by compressed air from a suitable compressed air source, not shown, through lines 12, 13, respectively. Suitably, each one of the nozzles, for example nozzle 10, is shaped similar to a hose clamp, that is, made of two longitudinally connected half-cylindrical parts, secured together for example by a screw, shown schematically at 15. This arrangement permits twisting the nozzle 10 about the supply pipe 12, and retightening the then reoriented structure, so that the air jet can be directed towards the web 5 under controlled and adjustable angles.

Changing the direction of the air jet emitted from the nozzles 10, 11 permits directing the jet in the direction between the web 5 and the respective cutting cylinder 1, 2, to compensate for variations in thickness of the web, or the number of web elements or plies thereof. The main feature is the adjustability; the nozzles, alternatively, can be secured to the respective supply pipes which, then, preferably, should be rotatable.

Supply pipes 12, 13 (FIG. 2) are connected to a source of compressed air, not shown, and of any suitable construction. Valves 16, 17 are located in the respective supply pipes 12, 13 between the compressed air supply and the nozzles 10, 11, to permit control of the volume of compressed air being supplied from the nozzles, which provides for additional matching of the supplied air to the thickness or number of plies of the web 5. Alternatively, each one of the compressed air lines 12, 13 may have their own compressors coupled thereto, which then preferably are individually controllable with respect to supplied volume of compressed air.

In accordance with a feature of the invention, a plurality of grooves 18, 19 are cut circumferentially into the cutter cylinders 1, 2. The grooves permit passage of the ejected air roughly parallel to the running direction of the web 5 through the nip formed by the cutter cylinders 1, 2, and thus forms an air cushions or air pillows at both sides of the web 5. These air cushions or pillows extend beyond the nip between the cylinders and guide the cut products in a direction towards the transport belts 6, 7. The grooves 18, 19, preferably, are aligned with the nozzles 10, 11 of the air jets.

Figure 3:
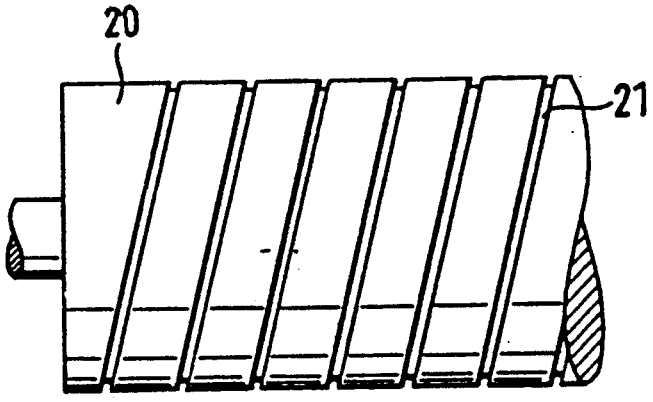
FIG. 3 is a schematic side view of a cutter cylinder illustrating another arrangement of air grooves.

In an alternative embodiment, shown in FIG. 3, cutter cylinders 20 can be used which contain only a single groove 21, extending spirally therearound, to guide the air emitted by the respective nozzles 10, 11.

Figure 2:
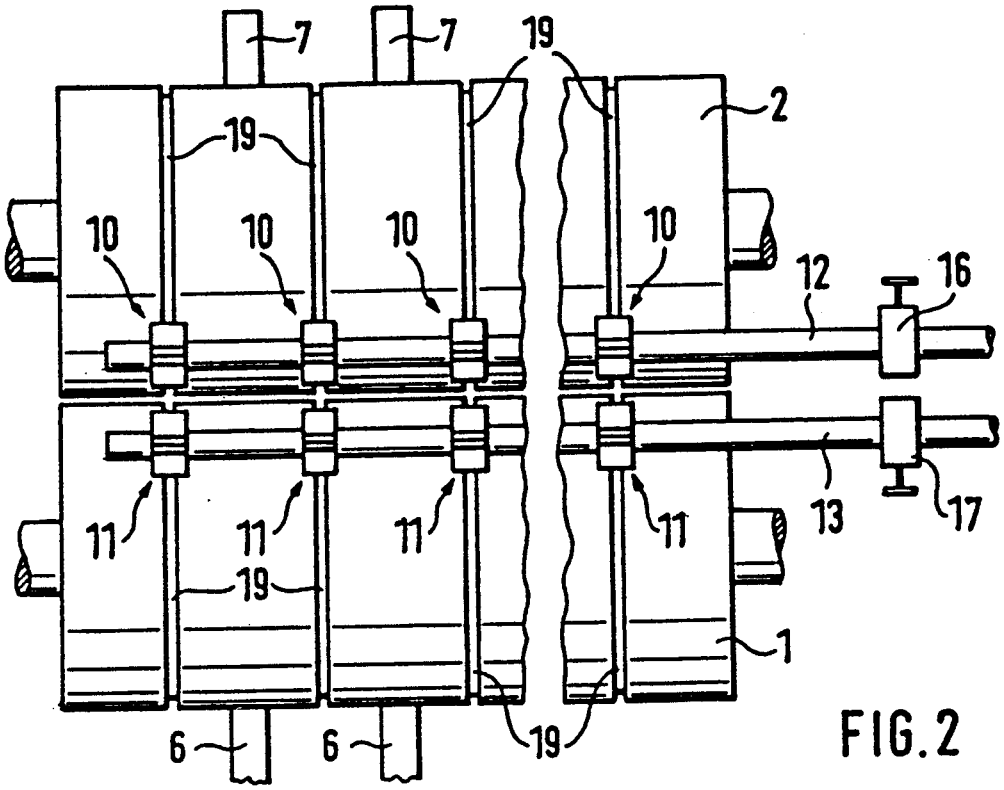
FIG. 2 is a top view of the arrangement, to a reduced scale.

In accordance with a preferred feature of the invention, suction nozzles 22, 23 are located between the deflection rollers 8, 9 of the respective belt elements 6, 7. The suction nozzles 22, 23, located close to and preferably overlapping the deflection rollers 8, 9, as seen in FIG. 1, should be angularly adjustable, by being secured, similar to for example nozzle 14, about respective suction pipes 26, 27, while permitting rotary adjustment thereof. The suction or vacuum pipes 26, 27 are connected to suction pumps or to a manifold and a common suction pump. Valves may be included in the lines 25, 26 to control the suction effect obtained by the nozzles 22, 23.

Operation

The web 5 which, as noted, may be a single or multiply structure, is guided towards the nip between the cylinders 1, 2 by air ejected from the nozzles 10, 11. This air passes through the grooves 18, 19 or 21, respectively, and forms an air cushion ahead of, at, and, particularly downstream behind the nip between the cylinders 1, 2, with respect to the direction of feed of the web 5 as shown by arrow a. This air cushion or air pillow prevents adhesion of the forward or leading edge of the web 5 to one or the other of the cutter cylinders 1, 2. Further, the web 5 is guided in a desired or design direction straight into the receiving gap between the deflection rollers 8, 9 and hence within the receiving gap of the transport belts 6, 7.

The arrangement is particularly suitable for use with webs 5 which are multi-ply or multi-web element combinations, since the air cushions or pillows on both sides of the web 5 have the tendency to hold the individual web units together. Use of the suction elements 22, 23 additionally and effectively eliminates possible diffusion of the air jet or air pillow and contributes to essentially straight line air flow from the jet nozzles, through the grooves 18, 19, or 21, respectively, on the cutter cylinders 1, 2 to thereby reliably guide the web, severed at the leading edge by the cutter blades 3, into the inlet region of the transport belts 6, 7 between the deflection roolers 8, 9.

Various changes and modifications may be made within the scope of the inventive concept.

I claim:

1. Rotary cutting system for cutting an at least one-ply traveling web (5) into web elements, and then removing the resulting cut web elements having a pair of cutter cylinders (1, 2) including at least one cutter blade (3) on one (1) of said cylinders, said web (5) being supplied to one side of a nip between said cylinders, said cutter cylinders being located axially parallel to each other and defining said nip therebetween, said web being fed into said nip from the one side thereof;

dual transport belt means (6, 7) at the other side of said nip and positioned for engagement of one belt each, at a respective side of the leading edge of the web passing through said nip;

belt guide means (9, 8) for guiding said transport belt means in a path to grip the web element cut by said cutter cylinders (1, 2) and comprising means for reliably guiding the leading edge of the web from between the nip until said leading edge is engaged between the dual transport belt means, said guiding means including means (10, 11) for generating an air jet at both sides of said web and at said one side of the nip, and further extending through the nip and beyond the nip into the vicinity of said belt guide means, said air jet generating means including air jet means (10, 11) located at both sides of the web and at said one side of the nip;

and at least one circumferential groove (18, 19, 21) formed in each of said cutter cylinders to guide air emitted by said air jets to pass along the web while it is traveling towards, through, and beyond said nip.

2. The system of claim 1, wherein said means for guiding the web further includes suction nozzles (22, 23) located at both sides of the web at said other side of the nip, to apply an air cushion by suction on both sides of the web and for guiding the web between said belt guide means (9, 8) and between the transport belt means (6, 7).

3. The system of claim 2, wherein said transport belt means (6, 7) comprises a plurality of laterally spaced belt or tape elements;

and said suction nozzles (22, 23) are located in the space between said belt or tape elements.

4. The system of claim 2, wherein the orientation of said suction nozzles with respect to the web (5) is adjustable.

5. The system of claim 2, wherein the degree of suction effected by said suction nozzles is adjustable.

6. The system of claim 1, wherein (FIGS. 1, 2) a plurality of grooves (18, 19) are provided, extending in circumferential circles around the circumference of said cylinders.

7. The system of claim 6, wherein said plurality of grooves (18, 19) and said air jet means (10, 11) are located in essentially axial alignment.

8. The system of claim 1, wherein said at least one groove comprises a spiral groove (21) spirally extending around the respective cutter cylinder.

9. The system of claim 1, wherein the angular orientation of said air jet means with respect to the web (5) is adjustable.

10. The system of claim 1, further including air jet control means (16, 17) positioned for controlling the volume of air being emitted by said air jet means.

11. The system of claim 1, wherein said air jet means (10, 11) and said at least one circumferential groove (18, 19; 21) are in essential axial alignment at least at selected circumferential positions of said cutter cylinders.

* * * * *